United States Patent [19]

Rez

[11] 4,021,979

[45] May 10, 1977

[54] ALIGNING BRACKET FOR UNDERGROUND SECTIONAL PRECAST CONCRETE STRUCTURES AND METHOD OF ASSEMBLY

[75] Inventor: Donald H. Rez, Newport Beach, Calif.

[73] Assignee: Associated Concrete Products, Inc., Santa Ana, Calif.

[22] Filed: June 21, 1976

[21] Appl. No.: 698,460

[52] U.S. Cl. ..... 52/127; 52/124; 52/135; 52/142; 52/169.1; 52/742; 33/174 Q

[51] Int. Cl.[2] ..... E02D 35/00; E04B 1/35; E04G 21/16

[58] Field of Search ..... 52/742, 747, 169, 127, 52/749, 745, 271, 124, 122, 135, 139, 140, 141, 142, 21

[56] References Cited

UNITED STATES PATENTS

| | | | |
|---|---|---|---|
| 1,678,504 | 7/1928 | Glover | 52/745 |
| 1,918,017 | 7/1933 | Christ | 52/127 X |
| 2,794,336 | 6/1957 | Ballon | 52/125 X |
| 2,828,618 | 4/1958 | Doescher | 52/749 |
| 2,886,370 | 5/1959 | Liebert | 52/127 X |
| 3,333,322 | 8/1967 | Toffolon | 52/747 |
| 3,788,026 | 1/1974 | Cook | 52/127 |
| 3,834,110 | 9/1974 | Vercelletto | 52/745 |

FOREIGN PATENTS OR APPLICATIONS

| | | | |
|---|---|---|---|
| 2,059,547 | 6/1972 | Germany | 52/135 |
| 278,034 | 2/1914 | Germany | 52/749 |
| 263,847 | 12/1968 | U.S.S.R. | 52/749 |

*Primary Examiner*—Leslie Braun
*Attorney, Agent, or Firm*—Knobbe, Martens, Olson, Hubbard & Bear

[57] ABSTRACT

An alignment bracket used in combination with an extendible pole having a hooked end provides lateral and rotational alignment for the interengagement of precast concrete sections of underground concrete structures during their construction, eliminating the need for workmen to enter an excavation for this purpose. The bracket is moved by the pole after each section is positioned to provide alignment for the next section. During alignment the sections can be moved both rotationally and laterally by workmen applying force on the bracket with the pole.

15 Claims, 8 Drawing Figures

ALIGNING BRACKET FOR UNDERGROUND SECTIONAL PRECAST CONCRETE STRUCTURES AND METHOD OF ASSEMBLY

BACKGROUND OF THE INVENTION

This invention relates to precast concrete structures placed in excavations and, more particularly, to apparatus and methods used for aligning sections of such structures during installation.

Concrete structures are placed in excavations for a variety of purposes, such as the housing of electrical and telephone equipment or as parts of storm drains and sewer systems. These structures are advantageously precast in sections to facilitate transportation from the casting facility to the installation site and are typically formed with tongue and groove mating walls which provide sealing and structural stability after installation.

In the prior art it has been common to install such structures section-by-section, first placing a floor section into a prepared excavation, placing a workman in the excavation of the floor section and lowering subsequent sections into place, as with a crane. The workman in the excavation pushes each section into place for engagement with a previously located section. These procedures often require on-site shoring of the excavation prior to placement of any of the concrete sections in order to assure that the excavation will not collapse and injure the workman. Such shoring substantially increases the labor required for installation of precast concrete structures and increases the cost of the installation. Furthermore, even such shoring does not provide sufficient safety for the worker in the excavation.

SUMMARY OF THE INVENTION

The present invention alleviates these difficulties with regard to the prior art without requiring substantial changes in the concrete sections themselves by providing an alignment bracket which is manipulated by an extendible pole having a hooked end. The pole is held by workmen on the surface adjacent the excavation. The invention therefore facilitates assembly without endangering workmen and without requiring shoring of the excavation prior to installation, reducing the ultimate cost of the installation.

The preferred embodiment bracket includes an elongate main body section of sufficient length to provide stable alignment of the bracket itself when this main body section is forced against a concrete section wall. The main body section includes a supporting flange extending in a plane normal to the length of the main body section adjacent one extremity of the main body section for supporting the alignment bracket in a proper location on a previously located concrete section. Below the support flange, an engagement flange extends in a plane parallel to the plane of the support flange in an opposite direction from the main body section. This equipment flange includes apertures to permit manipulation of the support bracket using hooks positioned at the end of the extendible pole. The engagement flange is positioned between the support flange and the midpoint of the main body section to provide adequate leverage for forcing subsequent concrete sections into place.

Extending at an angle from the extremity of the main body section adjacent the support flange is a camming member which is, in turn, provided at its extremity opposite the main body section with an eye used for manipulating the entire alignment bracket.

With the support flange resting on a previously positioned concrete section, the hooked pole is used to apply force to the engagement flange to force the alignment firmly against the previously positioned section. The camming member then provides a camming surface for guiding the next successive concrete section into position as it is lowered onto the installed structure. The engagement flange is preferably triangular in shape to fit within the corner of a square or rectangular concrete structure so that two such alignment brackets, positioned in diagonally opposed corners of the structure, are sufficient to align the sections as they are lowered.

The other end of the main body section opposite the camming member is conveniently provided with an offset foot. This foot is adapted to engage preformed apertures in the floor section of a concrete structure to permit the main body section of the alignment device to be used as a camming surface for installing the first wall section on the preformed floor.

The entire alignment bracket is thus moved from location-to-location within the structure as subsequent sections are lowered in place, and is removed altogether from the structure before the ceiling section is located. Thus, no substantial alterations need be made in the concrete structure itself to permit alignment of subsequent sections, and the structure which results has smooth interior and exterior walls which would be impossible if permanently installed alignment fixtures were located on each of the sections.

These and other advantages of the present invention are best understood through the following detailed description which references the drawings, in which.

DETAILED DESCRIPTION OF THE PREFERRED EMBODIMENT

Figure 1:
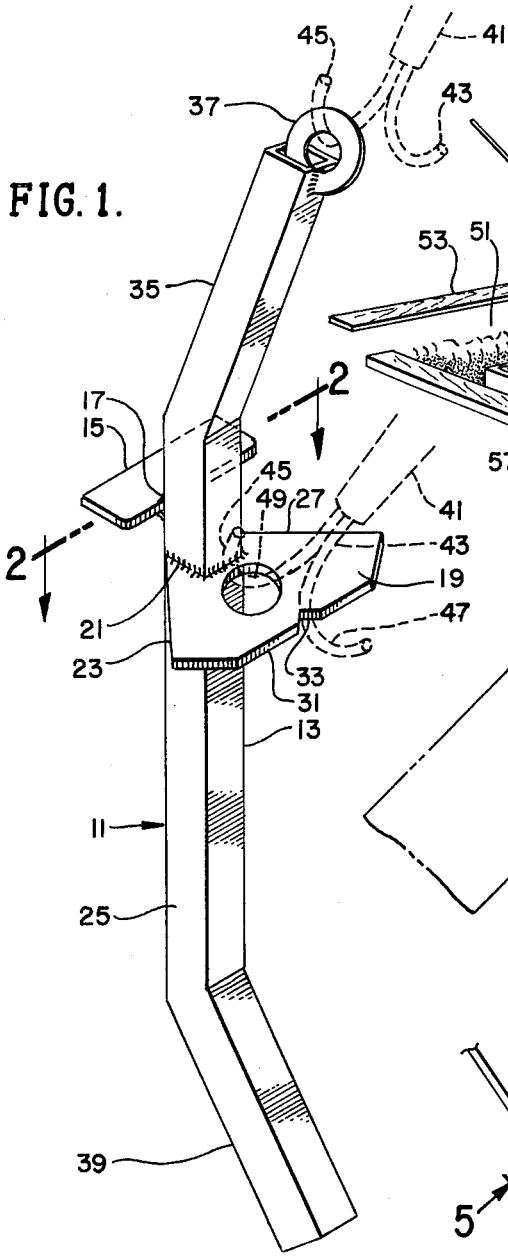
FIG. 1 is a perspective view of the alignment bracket of the present invention showing two alternate positions of the hooked pole used for its manipulation.
Figure 2:
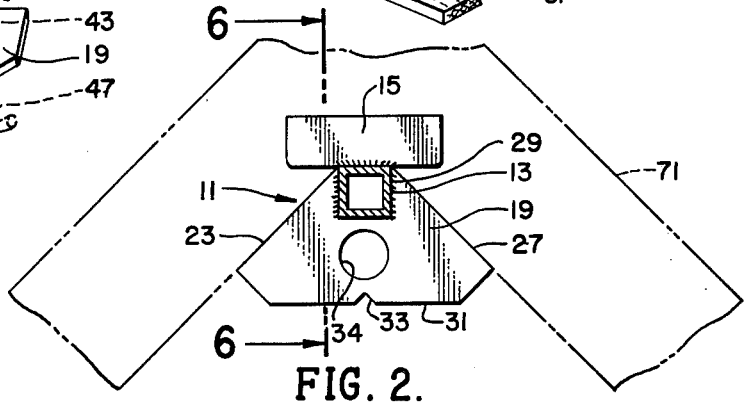
FIG. 2 is a sectional view taken along lines 2—2 of FIG. 1 showing the bracket as positioned on an upper corner of a previously installed wall section of the underground structure.

Referring initially to FIGS. 1 and 2, the alignment bracket 11 of the present invention includes a main body section 13, typically formed of square steel tubing having sufficient length to provide stable positioning of the main body section against the walls of concrete sections, as will be understood through the following detailed description of the use of the bracket 11. Extending in a plane normal to the longitudinal axis of the main body section 13, a support flange 15 is formed of flat metal plate and is typically welded in place, as at 17, to the main body section 13 a short distance from one end of the main body section 13.

An engagement flange 19 extends in a plane parallel to the plane of the support flange 15 and is attached, as by welding at 21, to the main body section 13 between the support flange 15 and the middle of the main body section 13. The engagement flange is substantially triangular in shape and is formed of flat metal. One triangular edge 23 extends at a 45° angle from one side 25 of the main body section 13, and a second edge 27 extends at a 45° angle from a second side 29. The remaining edge 31 includes a notch 33 for engagement with a hooked member, as will be described in more detail below, and the engagement flange 19 additionally includes a central aperture 34 for this same purpose.

Attached to one extreme of the main body section 13 adjacent the support flange 15 is a camming member 35 also conveniently formed from square tubing and extending from a smooth joint with the main body section 13. The camming member 35 includes a rigidly mounted eye 37 for manipulation by a hooked pole as will be described in more detail below. The remaining end of the main body section 13 includes an offset foot 39 formed substantially indentical to the camming member 35 from square tubing conforming in cross section to the tubing used to form the main body section 13. Each of the camming member 35 and offset foot 39 are angled relative the main body section 13 toward the engagement flange 19 and away from the support flange 15, this angle preferably being fairly small to provide adequate mechanical advantage during camming of the members in the manner described below.

The alignment bracket 11 is conveniently used in conjunction with an extendible pole 41 which may be formed, for example, of a pair of telescoping tubular members or alternately of plural solid rod sections which are interconnectable to adjust the length of the pole 41. One end of the pole 41 includes a pair of hooked members 43 and 45 extending in a single plane to form opposed bites 47 and 49, respectively. If desired, one of the hooked elements 43, 45 may be larger than the other to provide a smaller bite 47 for lifting and positioning the alignment bracket 11 and a larger bite 49 for forcing the alignment bracket 11 into position during use.

Figure 3:
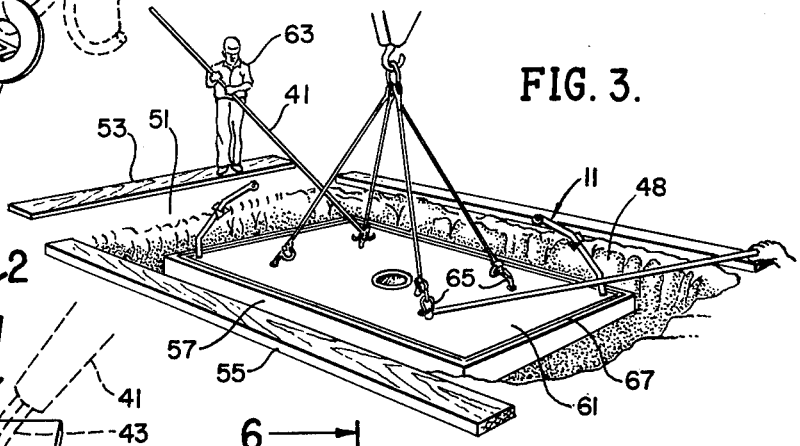
FIG. 3 is a perspective view showing the floor section of an underground structure being lowered into an excavation with two alignment brackets according to this invention positioned in opposite diagonal corners and the pole used for positioning of the floor section.

Referring now to FIG. 3, the first step in constructing the precast concrete structure will be described. As shown, an excavation 48 large enough to receive the entire structure is first dug in the ground surface 51 and perimeter planks 53 and 55 may be positioned to support workmen adjacent the edge of the excavation 48. A precast flat floor section 57 is first lowered by crane into the excavation 48. This floor section includes a pair of apertures 59 (see FIG. 5) in diagonally opposed corners of the upper surface 61 of the section 57. The apertures 59 pass only partially through the floor section 57 so that a pair of support brackets 11 may be positioned in the apertures 57 by inserting the offset foot 39 therein, prior to lowering of the section 57 into the excavation 48. The apertures 59 are preferably sufficiently large to permit the alignment bracket 11 to tilt well toward the center of the floor section 57, as shown in FIG. 3, so as not to interfere with the placement of the floor section 57. During the lowering of this section 57, workmen 63 using the poles 41 may grasp lifting hooks 65 to manipulate the floor section 57 into its correct position lying on the bottom of the excavation 48. It can be seen from FIGS. 3, 4 and 5 that the perimeter edge of the floor section 57 includes a groove 67 spaced inwardly from the outer perimeter. This groove 67, prior to placement of the floor section 57 in the excavation, is preferably lined with mastic 69 (FIG. 5) used for sealing this floor section 57 to the first wall section.

Figure 4:
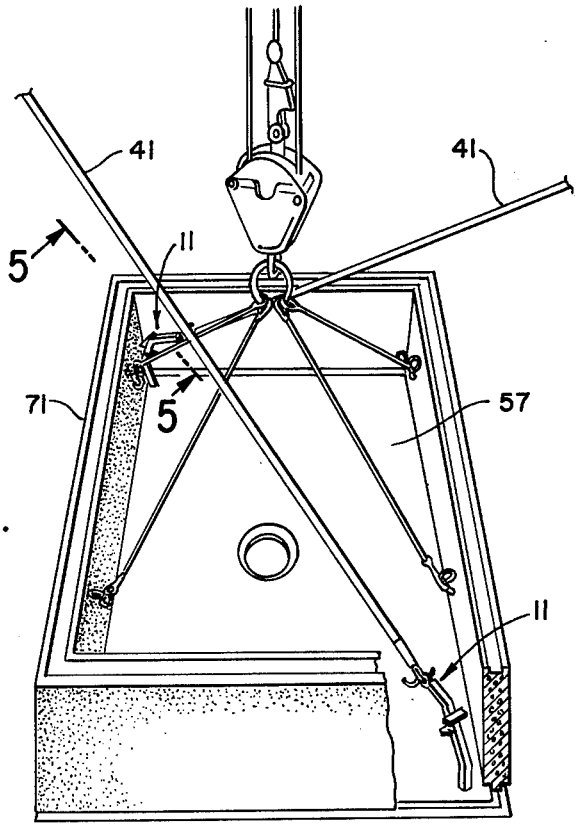
FIG. 4 is a perspective view, partially broken away, showing the use of the alignment brackets of the present invention for aligning the first wall section onto the previously positioned floor section.
Figure 5:
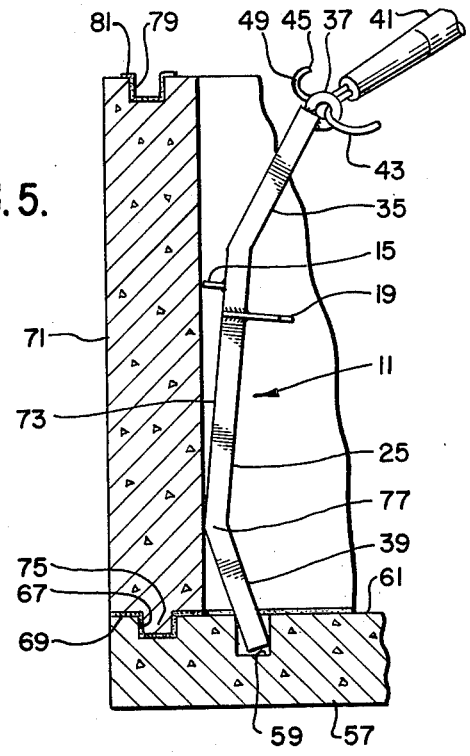
FIG. 5 is a sectional view taken along lines 5—5 of FIG. 4 showing the use of the main body section of the bracket of this invention for camming the first wall section into place.

Once the floor section 57 is in its proper position on the floor of the excavation 48, the first wall section 71 is lowered into the excavation 48, as shown in FIG. 4, to a position with its bottom perimeter spaced approximately one foot above the floor section 57. Two workmen manipulating poles 41 grasp the eye 37 at the upper end of the alignment bracket 11, as shown in FIG. 5, with one of the hooks 43 passing through the eye 37 and the bite 49 of the remaining hook 45 positioned against the eye 37, so that the top of the alignment bracket 11 can be forced toward the corner of the first wall section 71. With brackets 11 positioned in opposite diagonal corners and a pair of workmen pressing on the brackets 11 in a direction to force the main body sections 25 into the corners of the first wall section 71, the outer surfaces 73 of the main body portions 25 acts as camming surfaces so that, when the wall section 71 is lowered, it will cam on opposite diagonal corners against the surfaces 73 to guide the wall section 71 into a proper location. As shown in FIGS. 4 and 5, the lower extremity of the wall section 71 includes an extending tongue 75 for mating with the groove 67 and mastic 69 to physically position the wall section 71 relative the floor section 57 and to assure adequate sealing between these members. Use of the alignment bracket 11 assures that, as the wall section 71 is lowered, the tongue and groove members 67, 75 will be properly aligned for interconnection. It will be appreciated that a substantial lever is provided by the alignment bracket 11 so that force applied at the eye 37 by the pole 41 is sufficient to manipulate the lower wall section, the wall section 71 ultimately bearing against a knee 77 formed at the interconnection of the main body portion 25 and offset foot portion 39.

The upper extremity of the wall section 71 includes a perimeter groove 79, typically located at the center of the top surface of the wall 71. Prior to lowering the wall 71 into the excavation, the upper groove 79 is provided with a layer of mastic 81 for sealing the next successive wall section.

Figure 8:
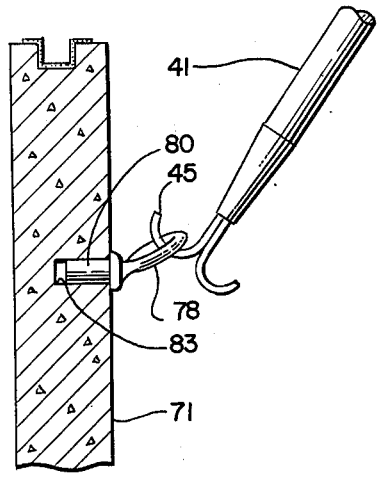
FIG. 8 is a sectional view showing the hooked pole of the present invention used for removal of lifting eyes from a wall section of the preformed concrete structure.

Once the first wall section 71 is in place and settled into the mastic layer 69, the hooked poles 41 may be used to lift the alignment brackets 11 out of the apertures 59. The hooked poles 41 are then used to remove plural eyes positioned in the walls of the unit 71. As shown in FIG. 8, these eyes 78 are typically connected to cylindrical rods 80 which are inserted into closely conforming cylindrical apertures 83 in the surface of the wall unit 71 so that, when a force is applied at an angle to the wall 71, the rods 80 become frictionally engaged with the aperture 83. The hook 45 on the pole 41, however, may be used to pull the rods 80 along their own axis, extracting them from the apertures 83.

Figure 6:
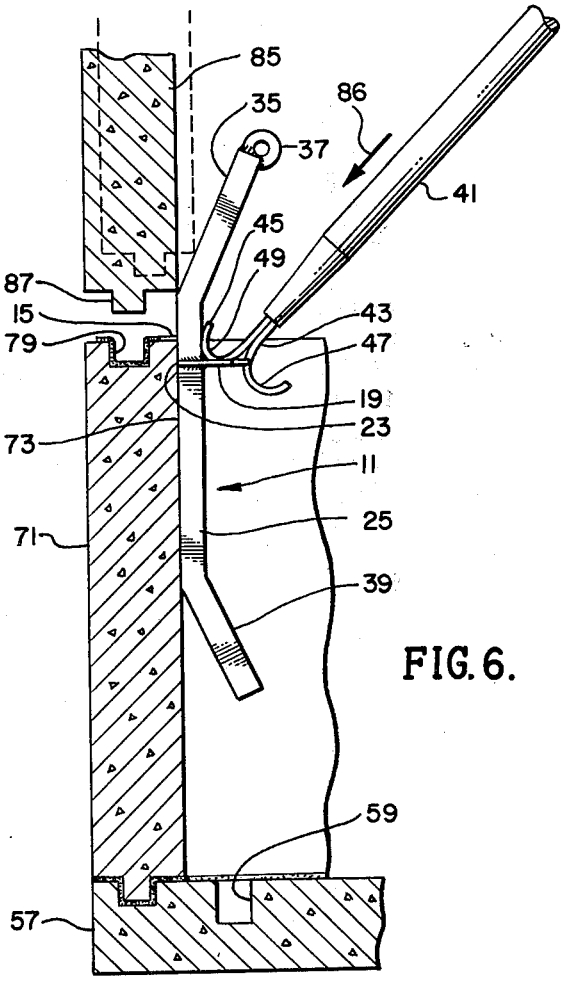
FIG. 6 is a sectional view taken along lines 6—6 of FIG. 2 showing the use of the bracket for aligning a second wall section on top of the first wall section.

The eyes 78 are then attached to the next succeeding wall member 85 as shown in FIG. 6, the wall member 85 is aligned over the excavation 48 and lowered to a position approximately one foot above the wall section 71. At this time, the poles 41 are used to place alignment brackets 11 in diagonally opposite corners of the wall section 71, with the flange 15 resting on the top of the wall unit 71 as shown in FIGS. 2 and 6. In this position, the triangular edges 23 and 27 of the engagement flange 19 will abut the two walls of the unit 71 to position the alignment bracket 11 diagonally in the corner of the wall unit 71. This is conveniently accomplished by grasping the aperture 34 in the engagement flange 19 with one of the hooks on the pole 41.

Figure 7:
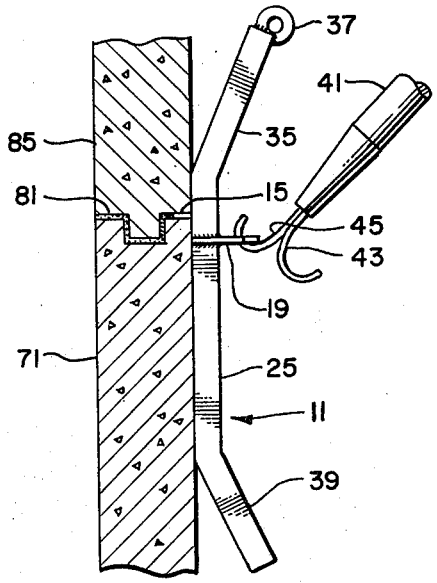
FIG. 7 is a sectional view similar to that of FIG. 6 showing the use of the hooked pole for removing the alignment bracket of the present invention.

The pole 41 is now moved to the position as shown in FIG. 6 with the bite 47 of the hook 43 resting in the notch 33 and the bite 49 of the hook 45 resting in the aperture 34. The workmen can now put substantial force in the direction of the arrow 86, that is, along the axis of the pole 41, to force the main body section 13 of the alignment bracket 11 into the corner of the first wall section 71. Since the engagement flange 19 is positioned below the support flange 15, this force will assure that the surface 73 of the main body section 25 lies flat against the wall section corner. As previously described, one such alignment bracket 11 is positioned in each diagonally opposite corner of the wall section 71 and the next succeeding wall section 85 is lowered into position. The lower corner of this wall section 85 will strike one or both of the camming members 35 of the alignment brackets 11. This camming action is shown clearly in FIG. 6, wherein a dotted line position of the second successive wall member 85 is shown guided to the solid line position by the camming portion 35. Once an extending tongue 87 on the lower face of the second wall member 85 has begun to penetrate the groove 79 at the top of the first wall member 71, the alignment bracket 11 may be gripped, as by passing the hook 45 through the aperture 34 in the engagement flange 19, to pull the alignment bracket away from the walls 71 and 85. This operation is shown in FIG. 7. It will be recognized by those skilled in the art that, even after the weight of the second wall member 85 is borne by the first wall member 71, the intervening mastic 81 will yield only slowly, so that, for a short period of time, the support flange is not gripped between the walls 71 and 85 and may thus be removed prior to complete settling of the mastic 81.

The two alignment brackets 11 are now moved to the top of the wall 85 if a succeeding wall member is to be positioned thereon. Successive movements of the brackets 11, each time to two diagonally opposed corners of a new wall member, permits the placement of as many wall members as are necessary to build the underground structure to its design height. Once this has been accomplished, a lid member (not shown) may be placed on the uppermost wall section. Tongues which extend from the perimeter edge of this lid member enter the upper groove 79 of the uppermost wall section for alignment and sealing. The alignment of this lid member may be accomplished in the same manner as shown in FIG. 3, that is, by grasping the eyes used to lift the lid member and manipulating the lid member to a proper location.

Since throughout this operation workmen have not been required to enter the excavation 48, no shoring of this excavation is required. Of course, once the structure is assembled in the excavation 48, excavation 48 may be backfilled around the structure, the structure providing all of the shoring that is required. Workmen may then enter the structure, as through a manhole provided in the top cover, to install whatever equipment is to be housed in the underground structure.

The alignment bracket is, of course, reusable, being moved from site-to-site to provide alignment for different precast structures. Since it is completely removed from the inside walls of the structure, these walls have smooth interfaces at the joints, as between the wall sections 71 and 85 in FIG. 7. The apparatus and method thus results in an inexpensive alignment tool useful in precast concrete structures without requiring substantial alteration of the structures themselves, providing substantially increased safety for the workmen by avoiding any necessity for them to enter the underground excavation 48.

What is claimed is:

1. An alignment member for use in assembling sections of underground precast structures, comprising:

an elongate main body section;

a support flange extending normal to the axis of said main section adjacent one end of said main body section;

an engagement member mounted on said main body section between the support flange and the longitudinal center of said main body portion, said engagement member comprising means for aligning said alignment member in the right angle corner of said sections of said underground precast structures, said aligning means comprising a pair of edges on said engagement member each extending at a 45° angle from a side of said main body section; and an elongate camming member extending from the end of said main body member adjacent said support flange, said camming member including a camming surface inclined relative the axis of said main body portion in a direction opposite said support flange.

2. A method of assembling precast sections of underground concrete housings, comprising:

forming an excavation in the earth's surface;

lowering a floor section into said excavation;

placing an alignment device on said floor section;

lowering a hollow wall section to a position spaced above said floor section;

grasping said alignment device from a position on the earth's surface adjacent said excavation using an elongate pole passing through said hollow wall section;

lowering said wall section to rest on said floor section while forcing said alignment device against said wall section with said pole; and removing said alignment device from said floor section using said pole.

3. A method of assembling precast sections of underground concrete housings as defined in claim 2 additionally comprising:

lowering a second hollow wall section to a position spaced above said hollow wall section;

placing an alignment device on said hollow wall section;

grasping said alignment device from a position on the earth's surface adjacent said excavation using said elongate pole passing through said second hollow wall section;

lowering said second wall section to rest on said hollow wall section while forcing said alignment device against said hollow wall section with said pole; and removing said alignment device from said hollow wall section using said pole.

4. A method of assembling precast sections of underground concrete housing as defined in claim 2 wherein said floor section includes a surface aperture and wherein said placing step comprises placing one end of said alignment device in said aperture.

5. A method of assembling precast sections of underground concrete housings as defined in claim 2 wherein said lowering of said wall section to rest on said floor section step includes the step of camming said wall section over a camming surfce on said alignment device.

6. A method of aligning concrete sections of a precast underground structure without placing workmen in the excavation comprising:

forming an excavation;

lowering a first wall section of said structure into said excavation;

lowering a hollow wall section to a position spaced above said first wall section;

holding an alignment device against said first wall section using a pole passing through said hollow wall section and manipulated from the surface adjacent said excavation; and lowering said hollow wall section onto said first wall section during said holding step.

7. A method of aligning concrete sections of a precast underground structure as defined in claim 6 additionally comprising the step of:

removing said alignment device from said first wall section using said pole before said hollow wall section is abutted against said first wall section completely.

8. A method of aligning concrete sections of a precast underground structure as defined in claim 7 wherein said removing step is accomplished from the surface adjacent said excavation.

9. A method of aligning concrete sections of a precast underground structure as defined in claim 8 wherein said first wall section includes sealing material on its upper surface into which said hollow wall section lowers slowly after the weight of said hollow wall section is borne by said first wall section, said removing step being accomplished prior to complete settlement of said sealing material.

10. A method of aligning concrete sections of a precast underground structure as defined in claim 6 wherein said lowering step includes the step of camming said hollow wall section on said alignment device to align said hollow wall section onto said first wall section.

11. A method of aligning concrete sections of a precast underground structure as defined in claim 6 additionally comprising the following steps which occur after the forming of the excavation and before the lowering of the first wall section:

lowering a floor section into said excavation;

holding an alignment device engaged against said floor section; and lowering said first wall section onto said first wall utilizing said alignment device for aligning said first wall section.

12. A method of using an alignment device having a flat side adjoining an offset camming surface for aligning concrete sections of a precast underground structure during placement of the sections in an excavation comprising;

holding said flat side of said alignment device against the wall of an installed section using a pole manipulated from the earth's surface adjacent the excavation; and lowering a subsequent wall section onto said installed section, said subsequent wall section riding on said camming surface into alignment, during said holding step.

13. A method of using an alignment device as defined in claim 12 additionally comprising:

repeating said holding and lowering steps for multiple sebsequent wall sections.

14. A method of using an alignment device as defined in claim 13 additionally comprising:

removing said alignment device from each of said installed sections after said lowering step for use in the next holding step.

15. A method of using an alignment device as defined in claim 12 additionally comprising the following preliminary steps:

installing a floor section in said excavation;

holding said alignment device against said floor section using a pole manipulated from the earth's surface adjacent the excavation; and lowering said installed section onto said floor section, said installed section guided by said alignment device into alignment with said floor section.

* * * * *

UNITED STATES PATENT OFFICE
CERTIFICATE OF CORRECTION

PATENT NO. : 4,021,979

DATED : May 10, 1977

INVENTOR(S) : Donald H. Rez

It is certified that error appears in the above-identified patent and that said Letters Patent are hereby corrected as shown below:

Column 2, line 7, after "ment", insert --bracket--.

Column 5, line 13, after first occurrence of "the", insert --support--; line 52, after "flange", insert --15--.

Column 6, line 29, after "main", insert --body--.

Column 8, line 18, delete "first wall", second occurrence, insert --floor section--; line 37, delete "sebesequent", insert --subsequent--.

Signed and Sealed this second Day of August 1977

[SEAL]

*Attest:*

RUTH C. MASON
*Attesting Officer*

C. MARSHALL DANN
*Commissioner of Patents and Trademarks*